United States Patent [19]

Bowerman

[11] Patent Number: 5,064,079

[45] Date of Patent: Nov. 12, 1991

[54] KNOCKDOWN HOIST WITH DOUBLE WINCHES

[76] Inventor: C. Dewayne Bowerman, 7210 W. 39th, Amarillo, Tex. 79109

[21] Appl. No.: 634,717

[22] Filed: Dec. 27, 1990

[51] Int. Cl.[5] ..... B66C 23/26

[52] U.S. Cl. ..... 212/182; 212/175; 212/196; 212/179

[58] Field of Search ..... 212/195–198, 212/178, 180, 182, 205, 209, 210, 218, 219, 225, 244, 254, 257, 265, 175

[56] References Cited

U.S. PATENT DOCUMENTS

| | | | |
|---|---|---|---|
| 510,495 | 12/1893 | Zetterberg | 212/175 |
| 655,522 | 8/1900 | Seaver et al. | 212/198 |
| 708,551 | 9/1902 | Hill | 212/175 |
| 2,699,874 | 1/1955 | Bernaerts | 212/175 |
| 3,494,492 | 2/1970 | Thiermann | 212/175 |
| 3,521,860 | 7/1970 | Zehrung, Jr. et al. | 212/175 |
| 4,003,479 | 1/1977 | Reyer | 212/244 |
| 4,113,112 | 9/1978 | Ray | 212/198 |
| 4,421,242 | 12/1983 | Brueske | 212/254 |

FOREIGN PATENT DOCUMENTS

| | | | |
|---|---|---|---|
| 678782 | 1/1964 | Canada | 212/175 |
| 1270100 | 11/1986 | U.S.S.R. | 212/175 |
| 1361103 | 12/1987 | U.S.S.R. | 212/195 |
| 2080235 | 2/1982 | United Kingdom | 212/182 |

*Primary Examiner*—Joseph F. Peters, Jr.
*Assistant Examiner*—R. B. Johnson
*Attorney, Agent, or Firm*—Richard C. Litman

[57] ABSTRACT

A portable wheeled hoisting frame includes two winches. The hoist disassembles, and the parts fit into a backpack. When assembled the frame has an open rectangular base with corner wheels, two upright members, and a top bar between the upper ends of the two upright members extending across above the open base. The primary winch is mounted on the top bar. There are top bar extensions. The hoist can vertically lift objects under the frame, as when straddling a scuttle hole, with the primary winch. A secondary winch attached to the hoisting frame can exert a sideways or downward force for cantilever lifting. The force of the secondary winch will then balance the weight of the object held by the primary winch. The extension bars allow hoisting in numerous ways. An object may also be supported on the frame base for rolling on supporting surfaces. There are two fixed wheels and two swivel castors on the frame.

6 Claims, 2 Drawing Sheets

KNOCKDOWN HOIST WITH DOUBLE WINCHES

FIELD OF THE INVENTION

The present invention relates to portable hoists.

DESCRIPTION OF THE PRIOR ART

A number of hoists are shown in the prior art.

Werner, et al., in U.S. Pat. No. 2,989,197, shows a four-wheel platform with a hoist mounted on it. The hoist comprises a single upright member with a rotatable arm atop it. A hook on a wire rope extends from the arm.

Gonzales, in U.S. Pat. No. 3,831,791, discloses a hoist comprising two parallel side parts, each with a bar held a few inches off the floor by a wheel at either end of the bar. Each bar has an upright rising from its middle, and triangulating braces from the upright to the bar on either side. The tops of the two uprights, and points on the triangulating braces, are connected to corresponding points on the other side. The whole structure thus has four wheels laid out in a rectangle. A strap winch is fixed to the a side of one of the uprights.

Reyer, in U.S. Pat. No. 4,003,479, shows a box frame with a hoisting arms inside the box. There are castor wheels on each lower corner of the box.

Moen, in U.S. Pat. No. 4,050,587, shows a hoist arm mounted on a cross bar. The ends of the cross bar are pivoted onto members shaped like the inverted letter U. The U ends each has a wheel, so that the four ends support the hoist.

A knockdown hoist is disclosed in U.S. Pat. No. 4,897,011 of Brower. The hoist, like that of Reyer, is an open box frame on four wheels. Gear racks like those of a bumper jack runs up the center of two opposing sides; sleeves slide on both racks, and levers on the sleeves engage the rack gears for raising the sleeves. The device of Brower is not suited for raising objects outside of the frame. Neither is it adapted to lift objects through a hole under the frame, as it has no wire winch.

None of the above inventions and patents, taken either singly or in combination, is seen to describe the instant invention as claimed.

The prior art is not seen to teach a knockdown hoist which is adapted to lift objects in a variety of situations. Neither does it show a hoist with double winches, where the winches are of the type retracting wire rope, chain, or other flexible tensile members. Nor does it disclose a hoist adapted to cantilever lifting of objects whose center of mass is outside of the area outlined by the feet or wheels of the hoist.

Accordingly, one object of the present invention is a knockdown hoist which quickly disassembles into generally linear elements for portability in a bag or backpack.

A further object is a hoist with two winches which can be attached to the hoist in various configurations for exerting forces on both a load and on another object for cantilevering loads off and edge.

A still further object is a hoist which has a pulley extension for overreaching an edge.

An additional object is a hoist with wheels for moving a load about a floor.

A final object is a hoist which will allow one person to install or remove an air conditioner or like heavy unit without assistance, by eliminating the need for help in lifting and positioning such a unit.

These and other objects of the present invention will become readily apparent upon further review of the following specification and drawings.

SUMMARY OF THE INVENTION

The present invention is a portable wheeled hoisting frame which includes two winches. The hoist disassembles, and the parts fit into a backpack. When assembled the frame has an open rectangular base with corner wheels, two upright members, and a top bar between the upper ends of the two upright members extending across above the open base. The primary winch mounts onto the top bar. The secondary winch mounts in various places. The frame assembles in several configurations. There are top bar extensions. The hoist can vertically lift objects under the frame, as when straddling a scuttle hole, with the primary winch; the secondary winch can exert a sideways or downward force for cantilever lifting (as when lifting the object off a truck bed, out of window, etc.). The force of the secondary winch will then balance the weight of the object held by the primary winch. The extension bars allow hoisting in numerous ways. An object may also be supported on the frame base for rolling on floors. There are two fixed wheels and two swivel castors on the frame.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
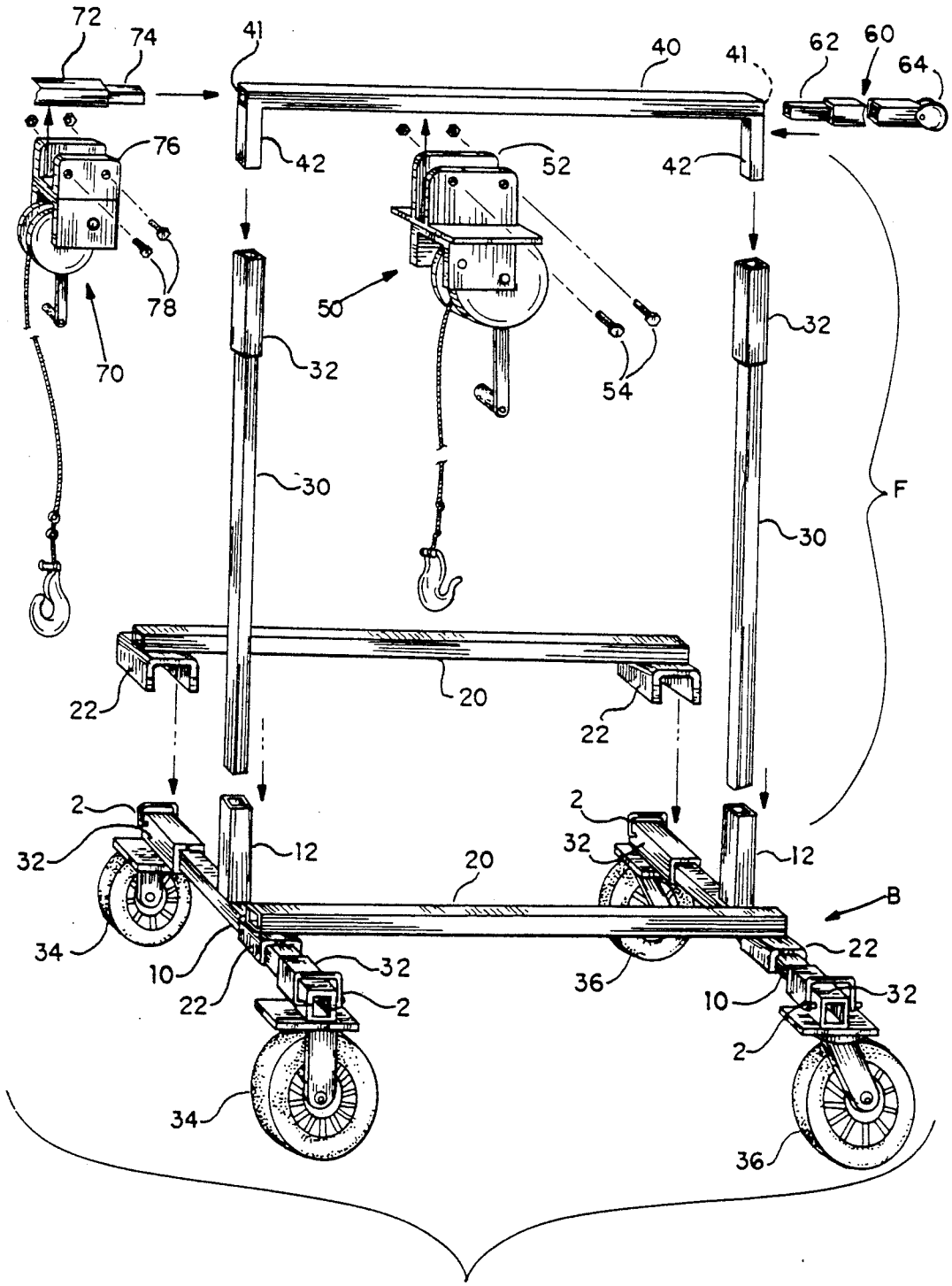
FIG. 1 is an exploded perspective view of the instant invention, a hoist, showing all the parts.

The present invention, a hoist for moving air conditioning units and other bulky, heavy objects, is shown exploded in FIG. 1. The winches and wheels are attached to a frame made of square section steel or aluminum tubing. The frame is preferably made of two different sizes of tubing; the smaller size fits fairly snugly within the larger size, so that a frame element of small tubing will slide into the open end of an element of large tubing. All of the various frame parts shown are joined in this manner, and the are held from sliding apart by lock pins 2 which pass through aligned holes in the inner small and outer large tubes of the joint. This construction makes for simple, fast assembly and disassembly.

The hoist consists of a wheeled base, an upper frame, two winches, and extensions.

The base B consists in part of a pair of foot bars 10, made of small tubing. Each foot bar 10 has welded to it a stem 12 of large tubing for accepting an upright leg 30 made of small tubing. The ends of the foot bars accept wheel assemblies. Each assembly includes a wheel bracket 32 made of large tubing to slide over the end of the foot bar 10, and, welded to the wheel bracket 32, either a fixed wheel 34 or a swivel castor wheel 36. (The two fixed-wheel assemblies are both put on one foot bar, and the two swivel wheel assemblies are placed on the ends of the other foot bar. The assembled frame then wheels about like a shopping cart.) The wheel brackets 32 are slid over the ends of the foot bars 10 and held with pins 2.

To complete the base B, two stabilizers 20 are provided. Each stabilizer, of small tubing, includes a pair of U-shaped foot brackets 22 welded onto the stabilizer ends. These foot brackets 22 allow the stabilizers to be placed directly onto the foot bar 10; when so placed they will hold the foot bars 10 a fixed distance apart and also hold them at right angles to the stabilizer 20.

The upper frame F consists of two upright legs 30 and a horizontal top bar 40. Each leg 30 slides into a stem 12 which is disposed on each of the foot bars 10, and may be held with a pin. The upper end of each leg 30 includes a welded 32 of large tubing to mate with the top bar 40. The top bar is of large tubing. It includes a welded post 42 at either end, which is of small tubing to fit the collar 32 of the leg 30. The post may be secured to the collar by a pin.

The primary winch 50, preferably rated at 1200 lb., removably attaches to the top bar 40 by means of a primary winch bracket 52. The U-shaped bracket 52 is secured to the top bar 40 by bolts 54. The winch can thus be mounted either above or below the top bar. The bolts positively lock the bracket 52 onto the top bar 40 to prevent the bracket from sliding along it. The two sides of the bracket are made flexible enough, and the fit of the bracket over the top bar snug enough, that tightening the bolts 54 draws the sides of the bracket 52 fast against the bar 40 and prevents the bracket from sliding by friction.

"Winch" herein means any device having a long, flexible tensile element, an attachment device at the end of the element, and a means for drawing the element into a storage device. Winches are commercially available in a variety of types.

The primary winch 50 is mounted below the top bar 40 for lifting heavy objects such as air conditioners which are below the upper frame F. For example, if the base B is straddling a scuttle hole or trap door, the stabilizers 20, riding on the foot bars, can be moved apart to allow the object held by the winch 50 above to pass up through the hole. Once the object is above the base B, the stabilizers 20 can be moved together and the object lowered onto them to support the object off the floor. The hoist is then easily and safely wheeled about to move the object.

The ends of the top bar 40 have openings 41 which can accept small tubing. An extension pulley bar 60 has a small-tubing post 62 welded into one end for insertion into the top bar opening 41 and a pulley 64 is welded into the other end. The extension pulley bar 60 when pinned will securely hold the pulley 64 in an extended position as shown in FIG. 2.

Figure 2:
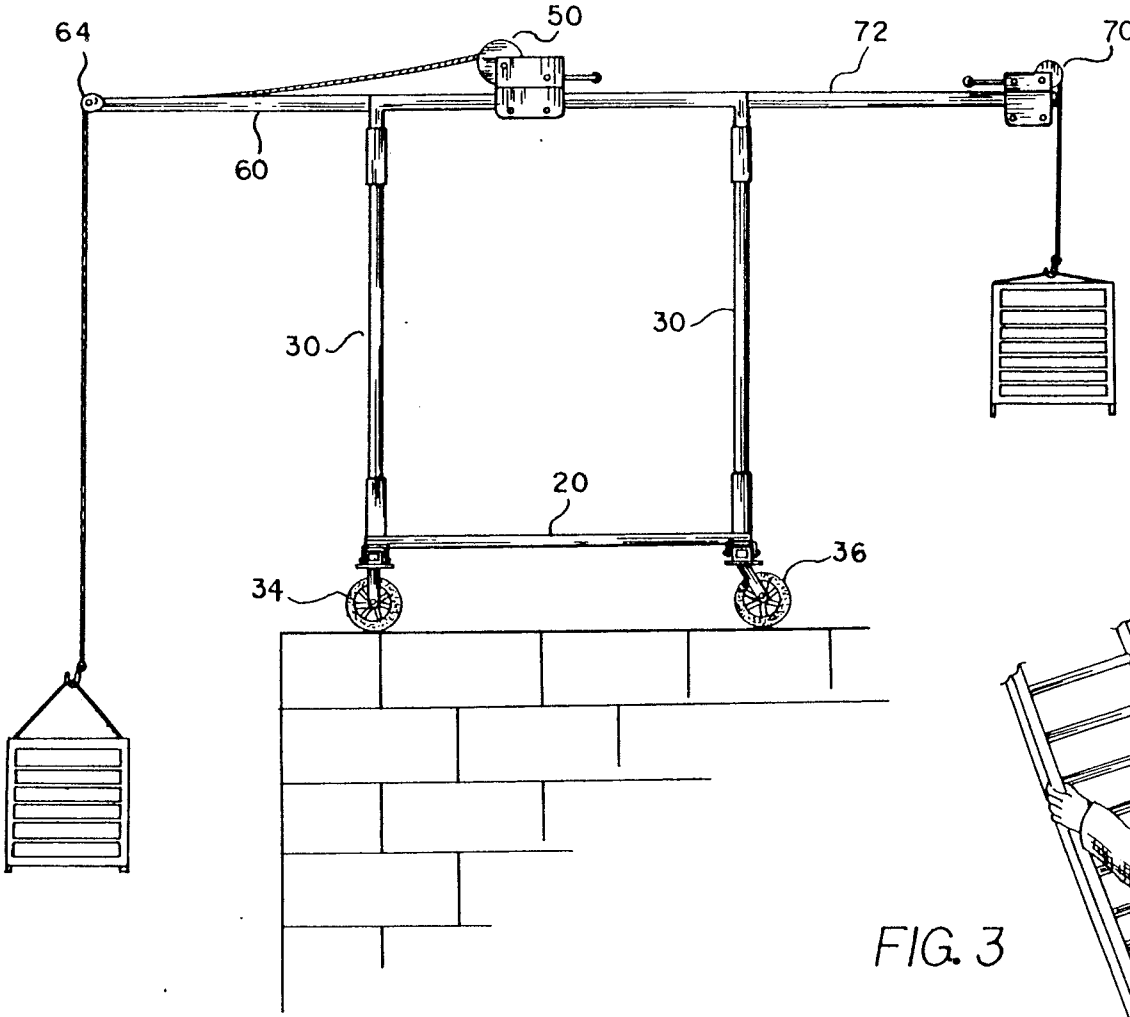
FIG. 2 is an elevation view of the invention assembled in a configuration adapted for cantilever lifting.

The pulley is adapted to reeve the wire rope of the winch 50 over it, when the winch 50 is mounted above the top bar 40 as shown in FIG. 2. This configuration is useful when an object must be lifted over the edge of step or ledge, as in raising an air conditioner alongside a building when the hoist is inside an upper window, or, when the hoist is on the ground and the object to be lifted is in a van or on the bed of a pickup truck. This kind of lifting is also done in replacing the compressor of an air conditioner.

Of course, the hoist is not stable in this situation, since it is not heavy enough to counterbalance an air conditioner, compressor, or other heavy object over the fulcrum of one pair of wheels. The weight of the load creates an unbalanced torque about the wheels, which must be cantilevered or balanced by another force. This needed other force is exerted by a secondary winch 70.

The secondary winch 70 is similar to the primary winch 50, but may be lighter duty, for example, 600 lb. rating. The winch 70 is fixed to a winch bar 72 of small tubing by a bracket 76 which is similar to the bracket 52 of the primary winch 50. Bolts 78 tighten the secondary winch bracket 76 at any convenient position along the winch bar 72. This bar 72 includes a post 74 extending from one opening 41. The post inserts into an end of the top bar 40 similarly to the extension pulley bar 60.

The secondary winch is mostly used to counterbalance objects hanging from the extension pulley bar. Suppose that a 1200-pound object is supported by the primary winch 50 whose wire rope is reeved over the pulley 64 as shown in FIG. 2. The 1200 pounds create a torque about the wheels 34 under the end of the top 40 from which the extension bar 60 protrudes. To counterbalance this weight, the secondary winch 70 at the end of the winch bar 72 can support another weight for counterbalance. The counterbalance weight, which is approximately twice as far horizontally from the fulcrum wheels as is the pulley weight, need be only about 600 pounds to prevent the hoist from toppling.

One application of counterbalancing is in replacing a compressor unit within a large fixed air conditioner. The hoist is set up as in FIG. 2 and the hoist is rolled so that the extension pulley bar is inside the air conditioner and above the compressor. The wire of the primary winch 50 is reeved over the pulley 64 and attached to the bad unit. The new unit is then attached to the secondary winch 70 at the end of the winch bar 72 extending from the hoist. Both winches are turned and the two compressor units are simultaneously lifted, each balancing the other. The hoist is then rolled back, removing the bad unit from the air conditioner. Next the units are switched (or the hoist is rotated 180 degrees) and the new unit is installed with the bad unit now acting as counterbalance.

Figure 3:
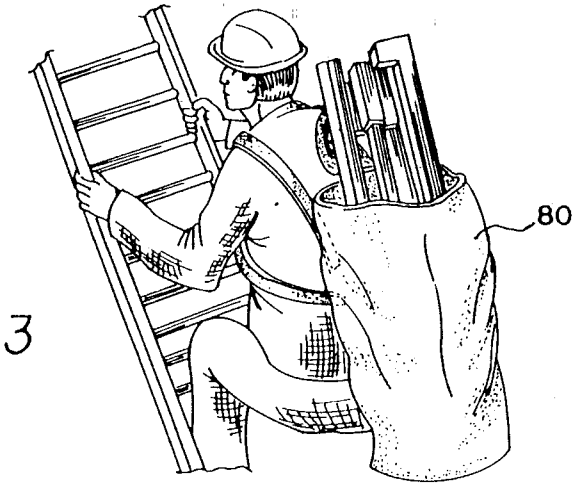
FIG. 3 shows a bag with straps for carrying the disassembled hoist.

The present invention thus allows a single worker to move heavy objects both vertically and horizontally in a wide variety of situations when the hoist is assembled. To further the usefulness of the hoist, it may be disassembled into wheels, winches, pins, and elongated pieces about three feet long, and then carried by means of a bag or backpack 80 as shown in FIG. 3. Using the pack, a worker such as an air conditioner repairer or installer can single-handedly climb to a roof or work area, assemble the hoist, and perform all the needed jobs. The hoist weighs about 50 pounds if made of aluminum and about 65 pounds when made of steel. Assembly and disassembly each take about five minutes. Thus one worker can do jobs that ordinarily would require two or three.

It is to be understood that the present invention is not limited to the sole embodiment described above, but encompasses any and all embodiments within the scope of the following claims. The frame may be made of any sort of strong material, and the frame joints need not be of the sliding type shown, but may of any type. The frame need not be rectangular, but could be a triangle or other shape.

I claim:

1. A hoist comprising:

a plurality of elongated base members, each of said members having opposite ends, means for connecting said ends to form a generally horizontal rectangular base with an open interior area;

a plurality of wheels, means for attaching said wheels to said rectangular base for moving said base over a supporting surface;

a plurality of vertical leg members with upper and lower ends, means for connecting the lower end of said leg members to said base;

horizontal bar means for connecting the upper ends of said leg members, said leg members and said horizontal bar means forming an upper frame;

a primary winch including a flexible element thereon for lifting objects, means on said primary winch for mounting same on said horizontal bar means in a plurality of vertically spaced positions, at least one of said positions being operative for lifting objects through said open interior area of said base and at least one of said positions being operative for lifting objects beyond said open interior area;

an extension bar with first and second ends, means for mounting said first end of said extension bar to said upper frame to extend said second end thereof in a first generally horizontal direction to a location beyond the interior area of said base, a pulley mounted on said second end, said pulley being operative to guide said flexible element from said primary winch to an object to be lifted beyond the interior area of said base;

a winch bar, means for attaching said winch bar to said upper frame to extend said winch bar in a second generally horizontal direction that is opposite to said first direction, to a location beyond the interior area of said base; and a secondary winch with means adapted to support a load attached thereto, means for mounting said secondary winch to said winch bar for movement of said load to selected spaced positions thereon to provide a counterbalance force for objects that are lifted beyond said interior area by said primary winch.

2. A hoist as in claim 1 wherein said base members includes:

a front foot bar having ends, and further including a wheel removably mounted at a respective opposite end of said front foot bar;

a rear foot bar having opposite ends, and further including a rear wheel removably mounted at a respective end of said rear foot bar;

two stabilizers connectable between said front foot bar and said rear foot bar, each said stabilizer including means for removably and slidingly engaging said front foot bar and said rear foot bar to form a right angle therebetween;

whereby said stabilizers may slide apart for winching an object through said open interior area, and slide together for supporting said object.

3. A hoist as in claim 2 wherein:

said front wheels include castors to freely swivel when mounted on said front foot bar.

4. A hoist as in claim 1 wherein said upper frame includes:

a horizontally extending top bar having a first end and a second end, said top bar disposed above said open interior area;

said leg members extending from said base to support said top bar.

5. A hoist as in claim 4 wherein:

said first end includes an opening to accept internally a portion of said winch bar to support said winch bar therefrom;

said second end includes an opening to accept internally a portion of said extension bar to support said extension bar therefrom; and said primary winch is removably and adjustably mounted to said top bar.

6. A hoist as in claim 5 wherein:

there are two of said leg members, one of said leg members being attached to said top bar adjacent said first end, the other one of said leg members being attached to said top bar adjacent said second end.

* * * * *